US007341457B2

(12) United States Patent
Lagathu et al.

(10) Patent No.: US 7,341,457 B2
(45) Date of Patent: Mar. 11, 2008

(54) ELECTRICAL OR OPTICAL CONNECTOR CAPABLE OF BEING IMMERSED IN A FLUID ENVIRONMENT

(75) Inventors: Cédric Lagathu, Louplande (FR); Josselin Legeay, Brains sur Gee (FR)

(73) Assignee: Carrier Kheops Bac, Le Mans (FR)

( * ) Notice: Subject to any disclaimer, the term of this patent is extended or adjusted under 35 U.S.C. 154(b) by 0 days.

(21) Appl. No.: 11/643,802

(22) Filed: Dec. 22, 2006

(65) Prior Publication Data

US 2007/0161272 A1 Jul. 12, 2007

(30) Foreign Application Priority Data

Dec. 26, 2005 (FR) ..... 05 13321

(51) Int. Cl.
*H01R 39/00* (2006.01)

(52) U.S. Cl. ..... 439/8

(58) Field of Classification Search ..... 439/8, 439/484, 483, 476.1, 246, 5, 281, 282
See application file for complete search history.

(56) References Cited

U.S. PATENT DOCUMENTS 575,615 A * 1/1897 Osyor ..... 191/34
1,911,395 A * 5/1933 Rowley ..... 439/263
1,957,714 A * 5/1934 Jones ..... 439/8
2,179,693 A * 11/1939 Goldstein ..... 219/120
2,231,565 A * 2/1941 De Reamer et al. ..... 439/8
2,971,178 A * 2/1961 Reesby ..... 439/8
3,656,057 A * 4/1972 De Luca et al. ..... 324/133
6,554,636 B2 * 4/2003 Walker et al. ..... 439/484
6,825,417 B2 * 11/2004 Ball ..... 174/74 R
7,056,125 B2 * 6/2006 Melis et al. ..... 439/8
7,172,453 B2 * 2/2007 Skluzacek et al. ..... 439/483
2001/0051456 A1 12/2001 Walker et al.
2006/0240703 A1 * 10/2006 Skluzacek et al. ..... 439/483

FOREIGN PATENT DOCUMENTS

FR 2 863 113 A1 6/2005

* cited by examiner

*Primary Examiner*—Michael C. Zarroli
*Assistant Examiner*—Phuongchi Nguyen
(74) *Attorney, Agent, or Firm*—Sughrue Mion, PLLC

(57) ABSTRACT

The invention relates to an electrical or optical connector of the type comprising a fixed male connector part or receptacle (3) having at least one axial contact pin (7), and a mobile female connector part or plug (1) capable of being coupled to the said receptacle (3) on its front part and having a female contact part, receiving the contact pin (7) upon coupling of the connector, the said plug (1) having a rear handle (11) allowing the coupling or uncoupling manoeuvre of the connector, for example by a remote-controlled vehicle, by means of an arm and an end pincer for gripping the said handle (11), characterized in that the rear body part (15) of the plug (1) has a cavity (19), capturing with limited angular displacement in axial alignment a ball-joint element (13) rigidly fixed to the said rear handle (11), the said ball-joint element (13) being held in along the axis of the plug (1) by a spring means (35), the ball-joint element (13) also comprising at least one longitudinal spline designed to engage into a complementary groove in the rear body part (15) of the plug (1), locking, with limited play, any freedom for the ball-joint element (13) to rotate relative to the body (15) of the plug (1).

12 Claims, 4 Drawing Sheets

ELECTRICAL OR OPTICAL CONNECTOR CAPABLE OF BEING IMMERSED IN A FLUID ENVIRONMENT

The invention relates to an electrical or optical connector capable of being immersed in a fluid environment and, in particular, a connector capable of being immersed in a marine environment and at great depths.

It is known that, for such connectors, their connection and disconnection are carried out by means of vehicles equipped with remote-controlled manipulators. These operations must be performed substantially within the axis of the contacts and are very difficult to carry out. There is a great risk of the connector being broken or damaged.

The invention aims to overcome these drawbacks and provides an electrical or optical connector capable of being immersed in a fluid environment, and notably in a marine environment, of the type comprising a fixed male connector part or receptacle having at least one axial contact pin, and a mobile female connector part or plug capable of being coupled to the said male part and having a female contact part, generally in the form of an elastic socket, receiving the contact pin of the said male part upon coupling of the connector, which is carried out with the retraction of at least one axial cover spring-loaded towards the front and closing, in a watertight manner, the front face of the female part in the unused position, the said mobile female connector part having a rear handle allowing the coupling or uncoupling manoeuvre of the connector by a remotely controlled vehicle, by means of an arm and an end pincer for gripping the said handle of the mobile female connector part, characterized in that the rear body part of the female connector part has a cavity, preferably axially symmetric, capturing with limited axial angular displacement a ball-joint element rigidly fixed to the said rear handle, the said ball-joint element being held in along the axis of the female connector part by a spring means pushing against the said rear body part and/or against the said handle, the ball-joint element also comprising at least one longitudinal spline engaged into a complementary groove in the rear body part of the female connector part, locking, with limited play, any freedom for the ball-joint element to rotate relative to the body of the female connector part.

The result of this disposition is that, upon coupling of the connector, even if the mobile part of the connector is not presented perfectly within the axis of its receptacle, the handle on the mobile part can angularly orientate itself according to the said permitted axial angular displacement in order to compensate for the coupling alignment angular offset and to allow the axial translation of the mobile part into the receptacle without risk of deformating or breaking the components.

Furthermore, the command for rotation of the mobile connector part relative to the receptacle is permitted, for example in order to position it at an aligning index of the receptacle.

The said axial alignment angular offset is of course small and can be variable.

The capturing of the said ball-joint element in the female rear body part is advantageously achieved by means of two half-rings receiving the ball-joint element and fixed to the body part, for example by means of screws, these rings also being able to be spaced from one another at their ends in order to accommodate two diametrically opposing grooves each receiving a longitudinal spline from the ball-joint element.

The said spring means can be an elastic sleeving or ring, for example made of an elastomer material which is resistant to the fluid of immersion and to the solvents potentially present, in axial compression around the periphery of and against the rear part of the mobile connector part and the rear handle, and for example against their opposing annular end flanges.

Moreover, for this same purpose of compensating and recovering the slight coupling and uncoupling axial alignment offset of the connector by a remotely controlled means in the fluid of immersion, the receptacle of the connector can comprise a cylindrical front part designed to receive and guide, with some given play, the complementary front part of the mobile connector part, this cylindrical front part being assembled with a slight axial angular flexibility onto the connector body of the receptacle.

The said assembly with slight angular flexibility of the front cylindrical part can be formed by a ring with axial elastic effect, comprising a series of partial circumferential slots, for example quarter circles, preferably regularly, axially spaced out around the periphery and angularly offset, preferably regularly, from one circumferential line of slots to an adjacent circumferential line of slots.

The said front cylindrical part of the receptacle can be rigidly attached to the ring, being axially slipped into the latter, advantageously by its rear part, and fixed to the latter, for example by means of peripheral screws, whereas the ring is coaxially fixed onto the body of the connector receptacle, advantageously by its rear collar attached to the body of the receptacle.

The elastic effect for axial flexibility of the ring is usually achieved by the widening of the slots in the ring.

It goes without saying that the said front cylindrical part comprising the contact part of the receptacle is assembled with water tight seals onto the body of the receptacle and usually tolerates a slight axial angular displacement integrally with the ring.

This disposition may be combined with the aforementioned handle axial angular displacement in order to absorb the slight coupling or uncoupling alignment angular offset of the connector by the said arm of the remote-controlled motorized vehicle, the elasticity in alignment holding of the handle coming into play concurrently and simultaneously with that of the alignment holding of the front cylindrical part of the receptacle by the assembly ring with elastic effect.

The invention is illustrated hereinbelow with the aid of an exemplary embodiment and with reference to the appended drawings, in which.

The description will be presented with reference to an immersed electrical connector, simply by way of exemplary embodiment of the invention, the latter being applicable to other types of connector, electrical or optical.

Reference will be made to the French patent application No. 03 14086 of the 1st Dec. 2003 in the name of the applicant and which relates to an electrical connector connectable in water or in a liquid environment, the connector according to the present invention being of the type described in this patent application.

Figure 1:
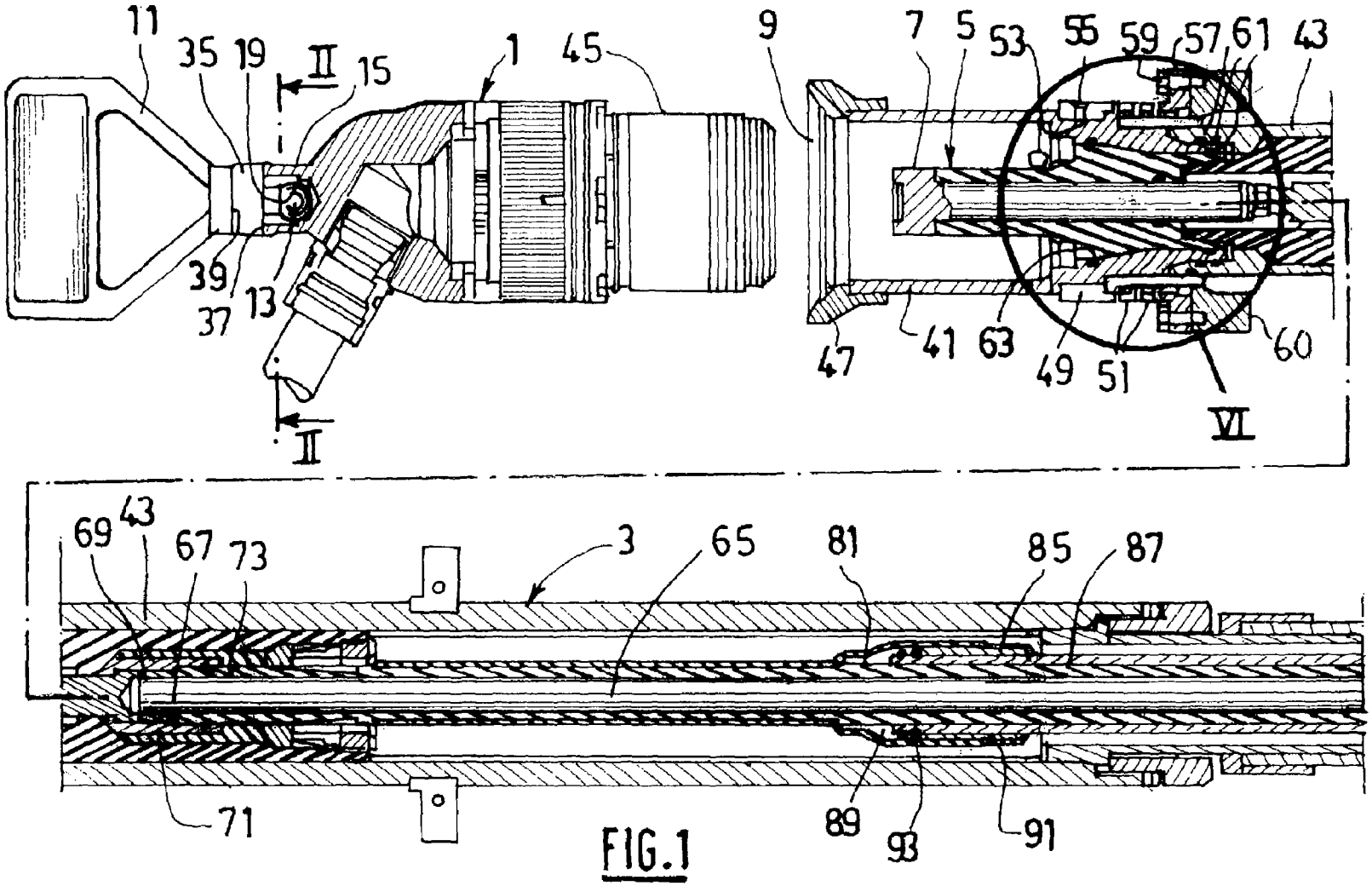
FIG. 1 is a partial axial cross-sectional view of an electrical connector according to the invention, in the disconnected position.

The connector according to the invention, such as is shown in FIG. 1, comprises a mobile connector part or plug 1 and a fixed connector part or receptacle 3. In the present case, the plug 1 is the female connector part and the receptacle 3 is the male connector part. This connector is of cylindrical form with axial symmetry and comprises a single contact 5 positioned in the axis of the connector, but it could comprise other identical contacts disposed in parallel within the cross section of the connector.

The receptacle 3 comprises a contact pin 7 of axial cylindrical form, disposed within the front part of the receptacle and slightly back from its opening 9.

When the connector is coupled together and the plug 1 is engaged into the receptacle 3, the pin 7 of the receptacle penetrates, in a sealed manner, into a complementary opening (not shown) of the front face of the plug, which face is closed in the unused position by a piston pushed forwards (not shown, reference may be made to the aforementioned patent application). It penetrates into a contact chamber (not shown), generally of the metal elastic socket type, where the contact is established when the connector is coupled together.

The coupling together and uncoupling of the connector are carried out by an axial translation engagement manoeuvre of the plug 1 into the receptacle 3. The effort demanded is significant (several tens of decanewtons) and requires an underwater (seawater for example) motorized propeller vehicle (not shown), equipped with an arm and a pincer for gripping a rear handle 11 of the plug 1, this vehicle being remotely controlled for executing the manoeuvre. The engagement requires the substantially axial positioning of the plug 1 relative to the receptacle 3 and a substantially axial pushing force or pulling force for uncoupling. A small translational angular offset relative to the axis is permitted. For this purpose, the handle 11 of the connector allows a small axial angular offset in the pushing or pulling force from the manoeuvring vehicle relative to the axis of the connector shown as a dashed-dotted line in FIG. 1.

Figure 2:
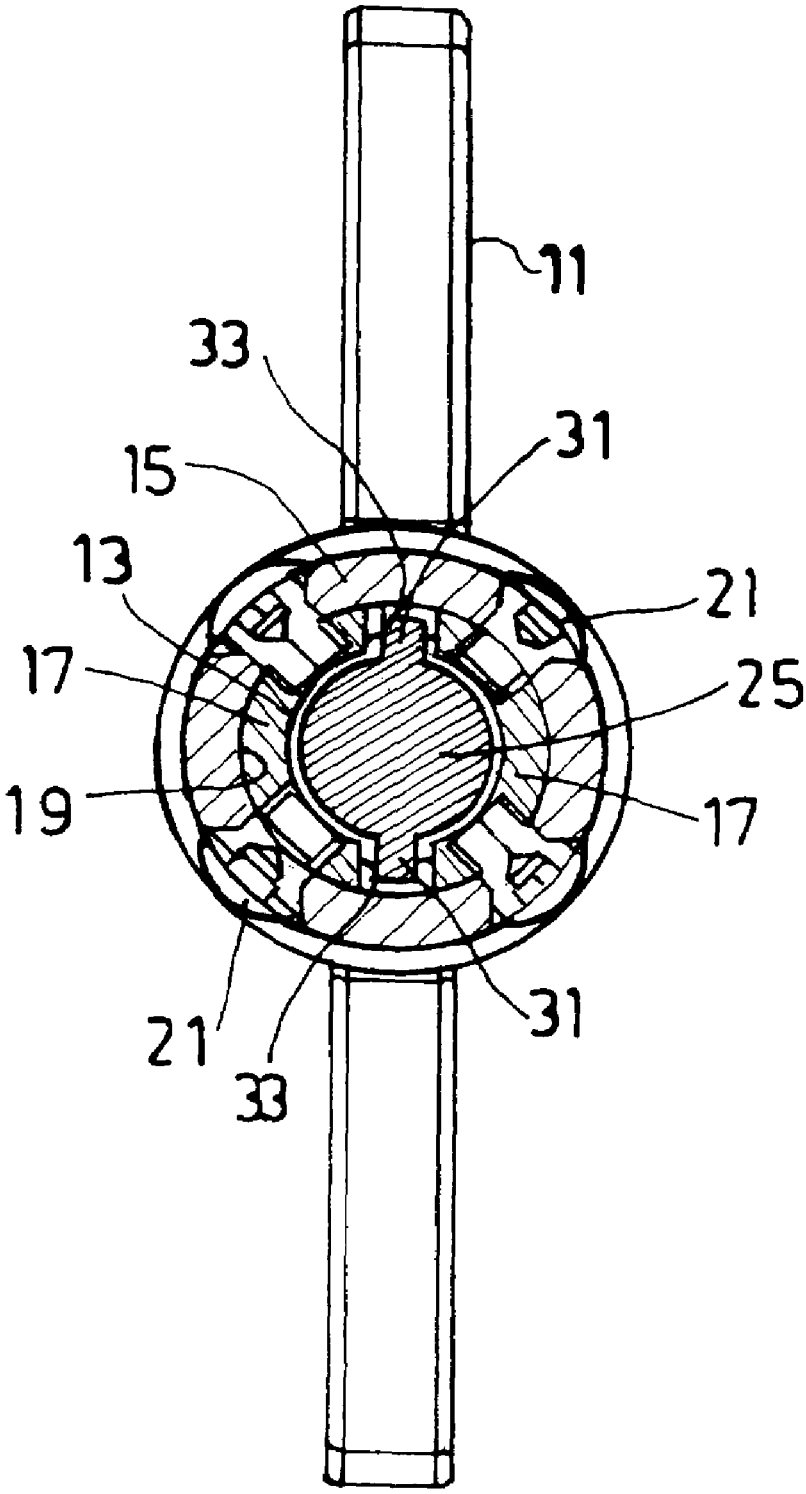
FIG. 2 is a transverse cross-sectional view of the connector along the line 2-2 in FIG. 1.
Figure 3:
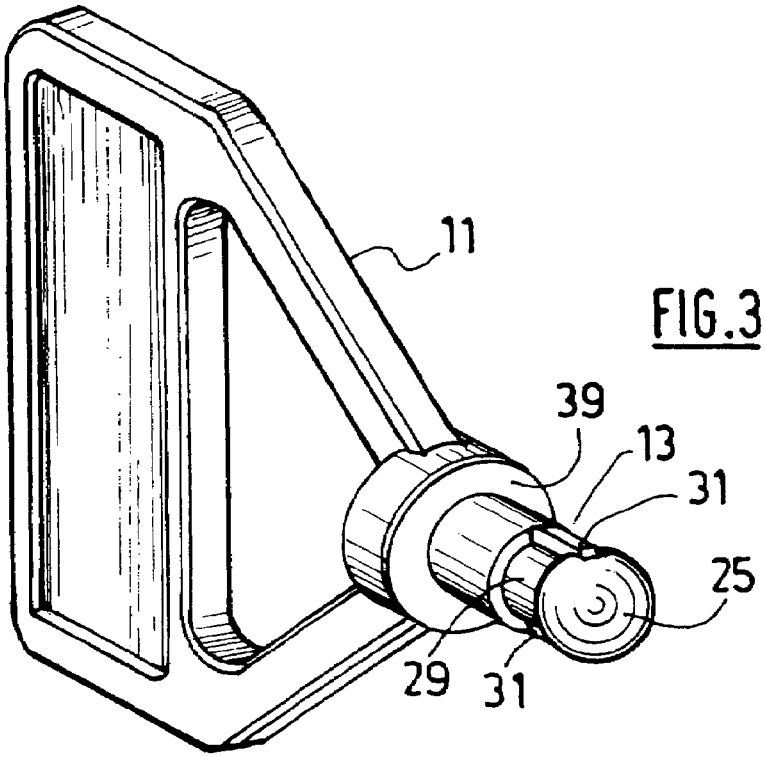
FIG. 3 is a perspective view of the manoeuvring handle of the mobile part of the connector with its front ball-joint element.
Figure 4:
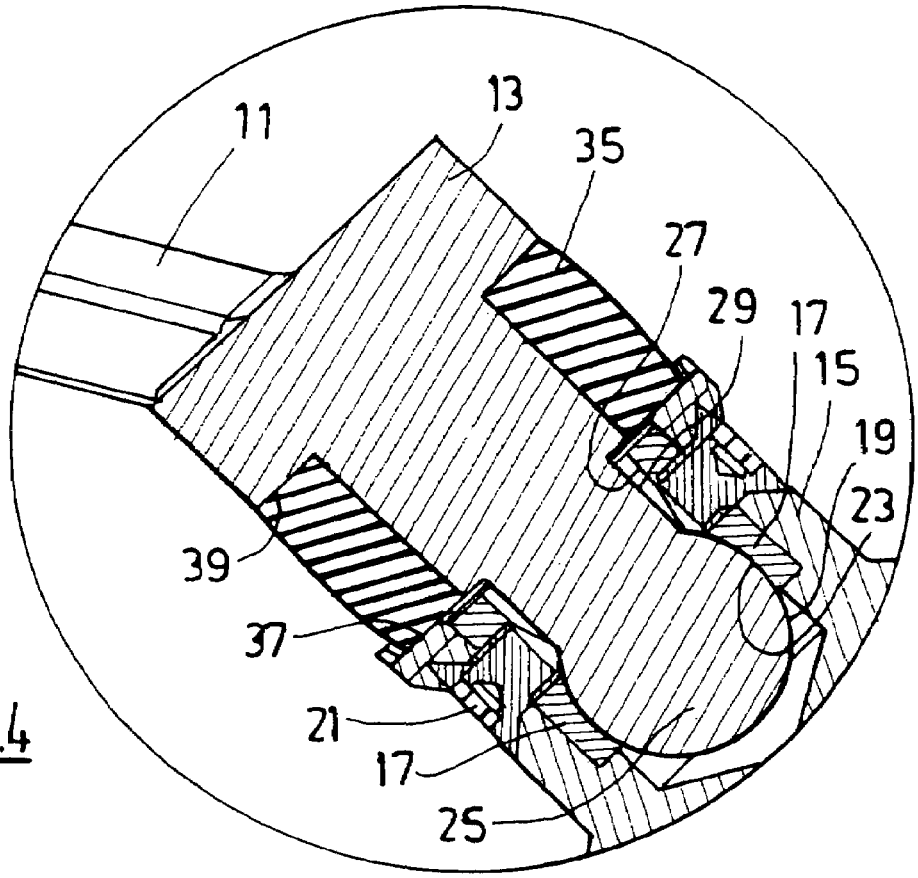
FIG. 4 is an enlarged axial cross-sectional view of the attachment of the handle to the mobile part of the connector.

To this effect, this handle 11 comprises a front ball-joint element 13 (FIG. 3) inserted into the rear body 15 of the plug 1 by means of two opposing half-rings 17 assembled into a corresponding axial cavity 19 of the latter. These half-rings 17 are fixed with a gap between their ends to the rear body 15 of the plug by means of screws 21: four screws disposed at a right-angle (FIG. 2) and screwed through the wall of the cavity 19 and into each of the half-rings 17 in pairs.

The half-rings 17 receive, with limited play, the ball-joint 25 of the ball-joint element 13 in a front complementary articulation alignment hole 23 and by their rear alignment hole 27, with limited axial angular displacement, the neck part 29 of the ball-joint element 13, which separates from the ball-joint 25 along a short cylindrical portion with a slightly smaller diameter than that of the ball-joint 25.

The maximum displacement of the ball-joint 25 within the half-rings 17 corresponds to the end limit of the ball-joint neck 29 against the rear alignment hole 27 of the rings. This displacement is for example ±5° of angle.

The neck part 29 of the ball-joint element 13 comprises two diametrically opposing splines 31 that each fit, with a small play, into the space 33 included between the ends of the half-rings 17 that are circumferentially spaced out for this purpose. At the same time, the ball-joint element 13 is installed articulated onto the rings 17 and locked in rotation according to the aforementioned small angular displacement also in the plane of the splines 31, and with the possibility of controlling the rotation of the plug 1 relative to the receptacle 3.

This ball-joint element 13 is held in axially (in line relative to the axis) by an elastomer sleeving 35 slightly compressed between the rear end annular flange 37 of the body 15 of the plug and a complementary opposing annular shoulder 39 formed at the front of the handle proper. This sleeving 35 provides the elasticity and the damping of the angular displacement of the plugging-in or unplugging manoeuvre and absorbs any rigidity from the jerkiness of manoeuvre which could damage the connector.

For this same purpose, the receptacle 3 comprises a front cylindrical part 41 (FIG. 1), assembled with a slight axial angular flexibility onto the body 43 of the receptacle, which receives, with a certain engagement play, the complementary front part 45 of the plug 1. A flared entry opening ring 47, made of plastic and rigidly fixed to this metal front cylindrical part 41 (made of stainless steel) facilitates the entry of the plug 1 into the receptacle 3 and absorbs any possible entry shocks. When the plug 1 is entered into the opening 47 of the front cylindrical part 41, the latter guides the connecting translation with a possible slight flexibility to the manoeuvring jerkiness, since it is assembled rigidly fixed to a rear ring 49 with axial elastic effect, itself fixed to the body 43 of the receptacle.

Figure 5:
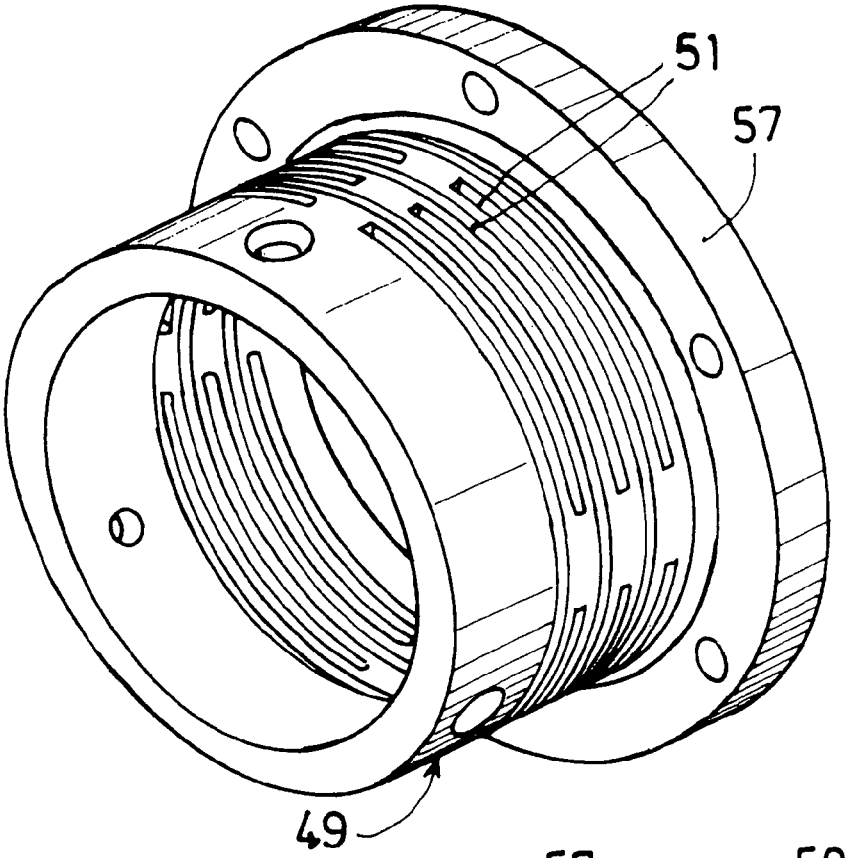
FIG. 5 is an enlarged perspective view of the ring with axial elastic effect of the connector receptacle.
Figure 6:
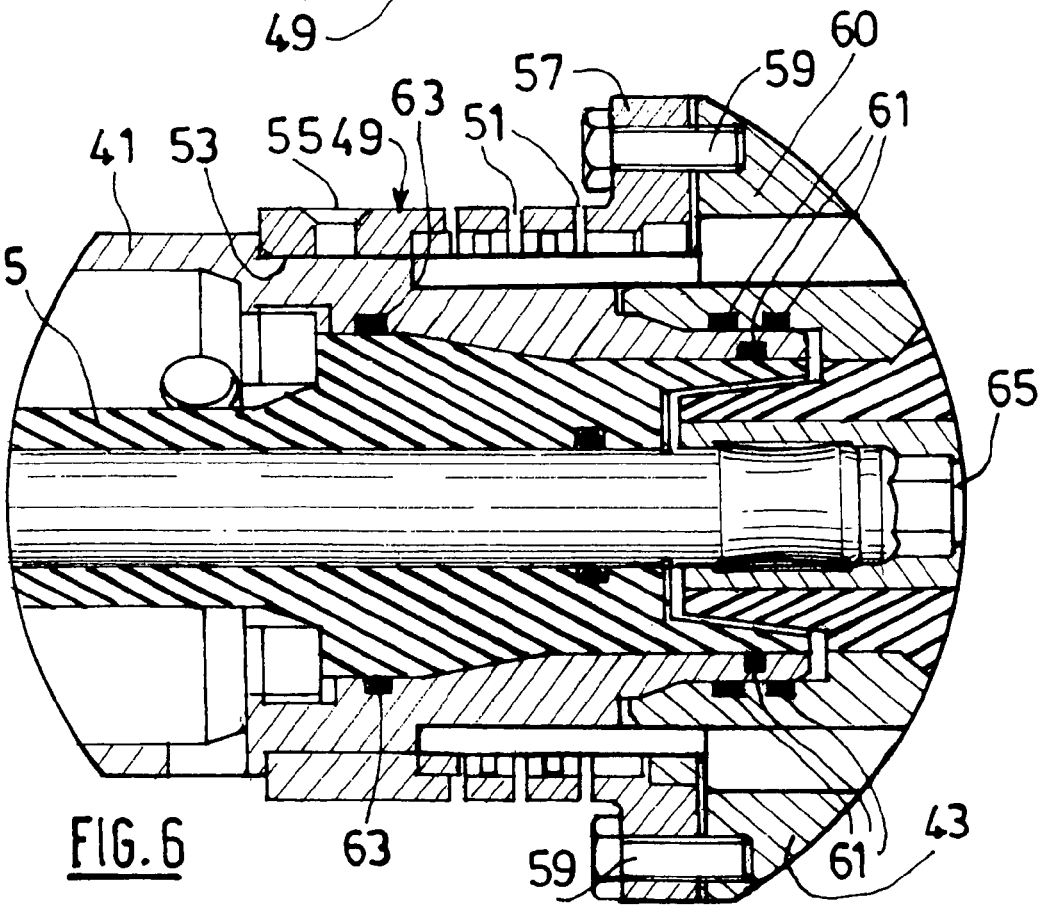
FIG. 6 is an enlarged axial cross-sectional view of the assembly of the ring with axial elastic effect of the connector receptacle.

This stainless-steel ring 49, indicated in the frame VI of FIG. 1 and shown in FIGS. 5 and 6, comprises a series of partial circumferential slots 51, each extending over a part of the circumference of the ring 49, with spacing from one slot 51 to the next on the same circumference. These slots 51, variable in number, are also axially regularly spaced out from one circumference to the next, substantially by the width of one slot 51. These slots 51 are also regularly offset from one circumference to the next, as can be seen in FIG. 5, preferably so as to then be again located at the same point every other circumference.

The front cylindrical part 41 of the receptacle 3 is slipped (FIG. 6) into the alignment hole 53 of the ring 49, with very little play, and is fixed to the latter by means of three screws 55 disposed at 120° from one another around the periphery of the front part of the ring 49 and screwed tightly against the corresponding wall of the cylindrical part 41.

The ring 49 also comprises a rear collar 57 thanks to which it is fixed by means of peripheral screws 59 onto the support housing 60 of the receptacle.

The front cylindrical part 41 is assembled with water-tight seals by its rear end, on three flexible O-rings 61, onto the rear body 43 of the receptacle and similarly on a flexible sealing O-ring 69 onto the periphery of the body of the contact element (electrically insulating rear part of the contact pin) under the front part of the ring 49.

The axial flexion of the front cylindrical part 41 of the receptacle is produced on the ring 49 by widening or narrowing of the slots 51 in the latter and the contact element 5 here axially accompanies the flexion of the ring 49, in such a manner that the whole receptacle moves simultaneously inside the ring 49.

This displacement of the front part 41, 5 of the receptacle 3 and of the receptacle itself simultaneously compensates, with the displacement of the handle 11, for any axial angular offset in the connection or disconnection translation of the manoeuvre and the possible jerkiness of the manoeuvre that may be caused by the eddies present in the fluid (marine) environment affecting the manoeuvring vehicle.

As variant embodiment of the invention, it will be noted that the ball-joint element may comprise at least one spline engaged in a substantially complementary slot, with a certain angular displacement play, installed in the rear part of the connector, this device allowing the rotation of the plug relative to the receptacle to be controlled and monitored by means of the said manoeuvring vehicle.

The invention thus provides an electrical or optical connector capable of being immersed in a fluid environment and with a high mechanical reliability.

The invention claimed is:

1. An electrical or optical connector configured for use in a fluid environment, comprising:

a fixed male connector part (3) comprising at least one axial contact pin (7), and a mobile female connector part (1) configured to be coupled to the male connector part (3) and comprising a female contact part in the form of an elastic socket that receives the contact pin (7) upon coupling of the male connector part with the female connector part; and wherein the coupling is carried out with retraction of at least one axial cover spring-loaded and closing, in a watertight manner, a front face of the female connector part (1) in an unused position, the female connector part(1) comprising a rear handle (11) configured to allow coupling or uncoupling of the connector by an arm and an end pincer for gripping the handle (11) of the female connector part (1); and wherein a rear body part (15) of the female connector part (1) comprises a cavity (19) that retains with limited angular displacement in axial alignment a ball-joint element (13) rigidly fixed to the handle (11), and wherein the ball-joint element (13) is held in along an axis of the female connector part (1) by a spring (35) pushing against (37) at least one of the rear body part (15) and the handle (11); and wherein the ball-joint element (13) comprises a ball joint (25) and a neck part (29) extending from the ball-joint and having a diameter slightly smaller than that of the ball-joint (25), wherein the neck part (29) is received, with limited axial angular displacement, by a rear aligning hole (27) defined by half-rings (17) diposed within cavity (19), and at least one longitudinal spline (31) configured to engage into a complementary groove (33) in the rear body part (15) of the female connector part (1), thereby locking, with limited play, rotation of the ball-joint element (13) relative to the rear body part (15) of the female connector part (1).

2. Connector according to claim 1, in which the limited angular displacement in axial alignment of the ball-joint element (13) is small and variable.

3. Connector according to claim 1, in which the limited angular displacement in axial alignment of the ball-joint element (13) is about ±5°.

4. Connector according to claim 1, in which the ball-joint element (13) is retained in the rear body part (15) by the two half-rings (17) receiving the ball-joint (25) of the ball-joint element (13) and fixed to the rear body part (15), and wherein the half-rings (17) are spaced from one another at ends of the half-rings to define two diametrically opposing grooves (33), each configured to receive a corresponding longitudinal spline (31) from the ball-joint element (13).

5. Connector according to claim 4, in which the ball-joint element (13) is retained in the rear body part (15) by the two half-rings (17) receiving the ball-joint (25) of the ball-joint element (13) and fixed to the rear body part (15) by screws.

6. Connector according to claim 1, in which the spring (35) is an elastic sleeve or ring in axial compression around a periphery of and against the rear body part (15) and against the rear handle (11).

7. Connector according to claim 6, in which the spring (35) is an elastic sleeve or ring in axial compression around the periphery of and against the rear body part (15) and against opposing annular flanges of the rear handle (11).

8. Connector according to claim 1, in which the male connector part (3) comprises a cylindrical front part (41) configured to receive and guide, with some given play, a complementary front part (45) of the female connector (1), the cylindrical front part (41) being assembled with a slight axial angular flexibility onto a connector body (43) of the male connector (3).

9. Connector according to claim 8, in which the assembly is formed by a ring with axial elastic effect (49), comprising partial circumferential slots (51), which are axially spaced out around the periphery of the ring, and angularly offset, from one circumferential slot to another adjacent circumferential slot.

10. Connector according to claim 9, in which the cylindrical front part (41) comprises a contact part (5) of the male connector and is assembled with watertight seals (61) onto the connector body (43) of the male connector, the contact part (5) and the front cylindrical part (41) tolerating a slight axial angular displacement integrally with the ring (49).

11. Connector according to claim 9, in which the cylindrical front part (41) of the receptacle (3) is rigidly attached to the ring (49), after being axially slipped into the latter and then being fixed to the latter, and wherein the ring (49) is coaxially fixed onto the connector body (43) of the male connector (3).

12. Connector according to claim 11, in which the cylindrical front part (41) of the receptacle (3) is rigidly attached to the ring (49), after being axially slipped into the latter then being fixed to the latter by peripheral screws.

* * * * *